US005730291A

United States Patent [19]

Smallwood

[11] Patent Number: 5,730,291

[45] Date of Patent: Mar. 24, 1998

[54] PROTECTIVE DISPLAY FOR CARD-TYPE ITEM

[76] Inventor: Michael L. Smallwood, 15410 W. 94th St., Lenexa, Kans. 66219

[21] Appl. No.: 452,128

[22] Filed: May 26, 1995

[51] Int. Cl.[6] ..... G09F 19/00

[52] U.S. Cl. ..... 206/455; 206/468; 206/579; 40/649

[58] Field of Search ..... 40/156, 649, 158.1, 40/139; 206/455, 468, 570, 586, 587

[56] References Cited

U.S. PATENT DOCUMENTS

| | | | |
|---|---|---|---|
| D. 316,877 | 5/1991 | Mitchell | 40/649 X |
| 4,829,691 | 5/1989 | Manjos et al. . | |
| 4,979,619 | 12/1990 | Hager . | |
| 4,980,982 | 1/1991 | Verdon et al. | 40/649 X |
| 5,010,673 | 4/1991 | Connor et al. . | |
| 5,097,953 | 3/1992 | Gingras . | |
| 5,119,574 | 6/1992 | King . | |
| 5,121,563 | 6/1992 | Connor et al. . | |
| 5,129,614 | 7/1992 | Kohl | 40/649 |
| 5,133,450 | 7/1992 | Rademacher . | |
| 5,224,600 | 7/1993 | Neugebauer . | |

FOREIGN PATENT DOCUMENTS

| | | | |
|---|---|---|---|
| 174692 | 1/1922 | United Kingdom | 40/649 |

*Primary Examiner*—Kenneth J. Dorner
*Assistant Examiner*—Cassandra Davis
*Attorney, Agent, or Firm*—Litman, McMahon and Brown, L.L.C.

[57] ABSTRACT

A protective display for a card-type item with a backing card includes a base and a frame assembly. The base includes a field portion generally surrounding the frame assembly. The frame assembly includes a panel and a plurality of rails extending forwardly therefrom and generally forming the boundary of a view area for receiving the display item. The rails form notches for receiving the backing card edges whereby the display item is retained on the display.

16 Claims, 2 Drawing Sheets

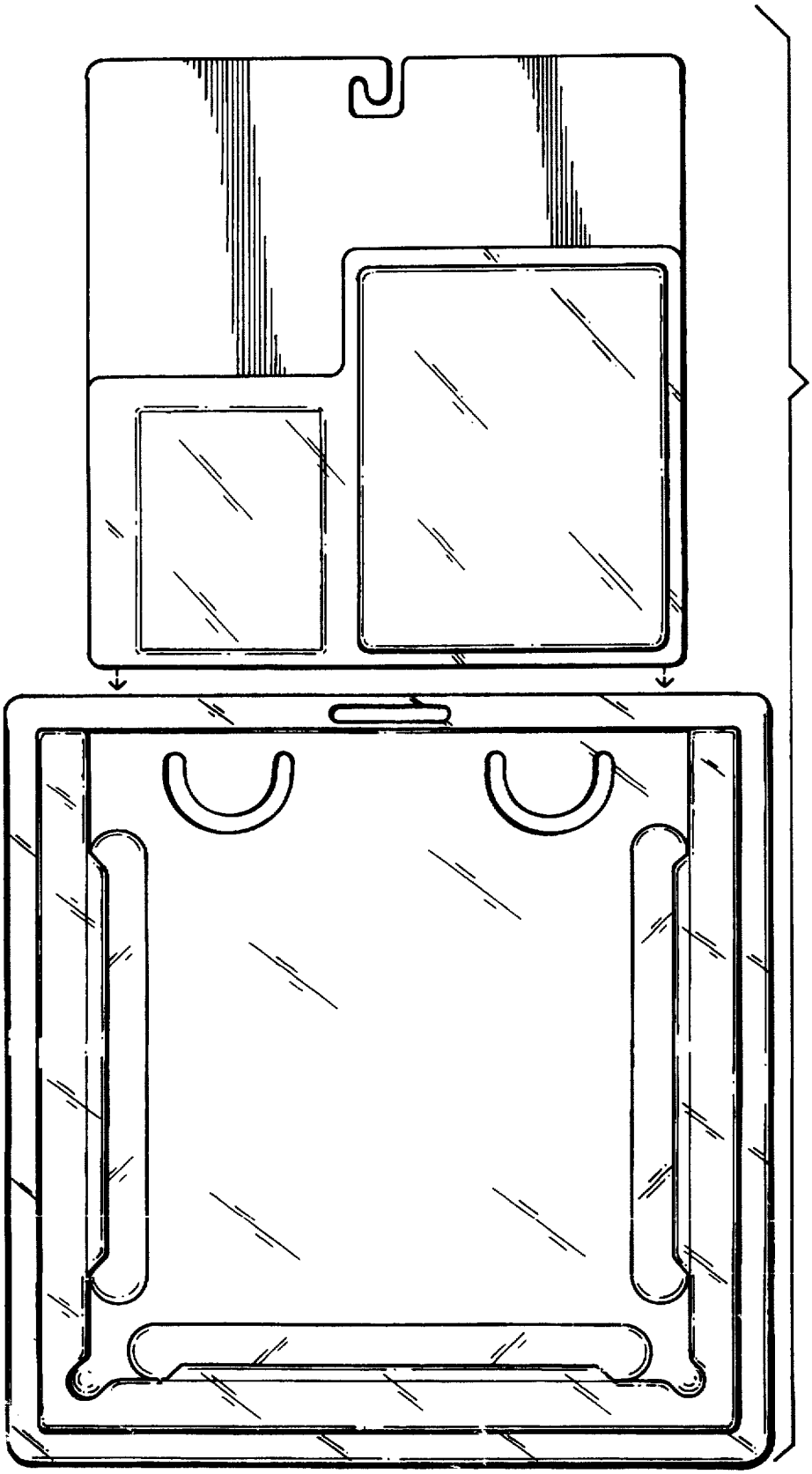
FIG. 2.
FIG. 3.
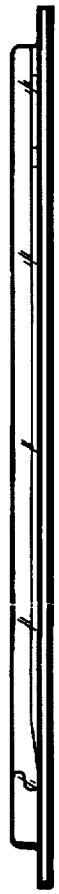

PROTECTIVE DISPLAY FOR CARD-TYPE ITEM

BACKGROUND OF THE INVENTION

1. Field of the Invention

The present invention relates generally to display devices, and in particular to a device for displaying items including or comprising cards or other types of backing in a protected manner while prominently displaying front portions of the items being displayed.

2. Description of the Related Art

Display devices are commonly used for a wide variety of items being displayed and various designs thereof have heretofore been proposed for satisfying the requirements of particular display applications.

Among the types of items commonly displayed by their owners are printed materials and two-dimensional artwork of various types. Such display items are sometimes mounted in frames, which can include transparent faces comprising, for example, glass or transparent plastic. However, picture frames and other similar display devices for two-dimensional display items are generally not well suited for displaying three-dimensional objects.

Three-dimensional display objects can comprise a variety of items, ranging from fine art sculpture to relatively inexpensive three-dimensional decorations and the like. The popularity of three-dimensional display items has grown considerably with the commercialization of "action figures" and particularly action figures and similar items which are often referred to as "collectibles". The field of collectibles includes a wide range of items which are deemed worthy of acquisition and retention. The values associated with such items can sometimes increase significantly over the original retail sales prices. Such values can be influenced by a number of factors, including, for example, the popularity of the subject matter of the collectible, the relative scarcity thereof, and its condition. Thus, action figures depicting highly popular athletes, action heroes and screen and broadcast persona tend to be very much in demand. Likewise, out-of-production figures may be relatively valuable if they are in demand and in scarce supply. Such popularity for collectibles can come many years after the popularity of a particular athlete, star or program has peeked in popularity and retired or gone out of production. Thus, nostalgia can play a significant role in such trends in the popularity of various collectibles.

In view of the importance of maintaining such collectibles in the best possible conditions, collectors often store them in boxes and other storage containers. Extremely valuable collectibles may be stored in safe deposit boxes at financial institutions and in other secure depositories.

However, collectors often face something of a dilemma in connection with storing or displaying the collectible items. For example, there are numerous opportunities to display and deal in a wide variety of collectible items, including trade shows and exhibitions, which often involve particular themes and attract collectors from large geographic areas. However, displaying valuable collectibles at trade shows can involve risks of damage or loss. A common type of damage involves the edges and corners of the cards on which the collectibles are mounted, which are particularly susceptible to damage when the collectibles are dropped. Moreover, the relatively small size of many collectibles renders them more vulnerable to loss. Serious collectors thus frequently find themselves having to choose between storing their collectibles in relatively safe but concealed locations and displaying them with the attendant risks associated with unprotected displays. Since much of the satisfaction associated with collecting such items is derived from displaying them to others and dealing in them through sales, trades and the like, collectors often risked valuable pieces by placing them on semi-public display in relatively unprotected conditions.

Heretofore there has not generally been available a protective display device for collectibles including or comprising cards which protected a collectible while permitting the display thereof with the advantages and features of the present invention. The present invention addresses the aforementioned problems.

SUMMARY OF THE INVENTION

In the practice of the present invention, a display is provided for a display item including or comprising a backing card with front and back card faces and upper, lower and opposite side edges. A three-dimensional figurine can be provided and mounted on the backing card. The display includes a base with a field portion. The display further includes a frame assembly mounted on the base and projecting forwardly therefrom. The frame assembly includes multiple rails which form notches for receiving respective card edges. Tabs are formed by semi-circular cut-outs in the frame assembly for securing an upper edge of the card.

OBJECTS AND ADVANTAGES OF THE INVENTION

The principal objects and advantages of the present invention include: providing a protective display for items including or comprising cards; providing such a display which provides protection for display item cards and other backing, including the edges and corners thereof; providing such a display which provides a substantially unobstructed view of the display items; providing such a display which facilitates relatively easy insertion and removal of a display item without damage thereto; providing such a display which is compatible with the appearance of action figure-type display items; providing such a display which does not detract from the appearance of a display item; providing such a display which can be formed from polyvinyl chloride (PVC) plastic and other materials with relatively low material costs; providing such a display which can be manufactured from a variety of materials; providing such a display which is adapted for efficient front-to-front storage of displays with display items in juxtaposed positions; and providing such a display which is economical to manufacture, efficient in operation and particularly well adapted for the proposed usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 2 is a front elevational view thereof, showing the card-mounted collectible in the process of being inserted into the display.

FIG. 3 is a side elevational view of the protective display.

DETAILED DESCRIPTION OF THE PREFERRED EMBODIMENTS

I. Introduction and Environment

Figure 1:
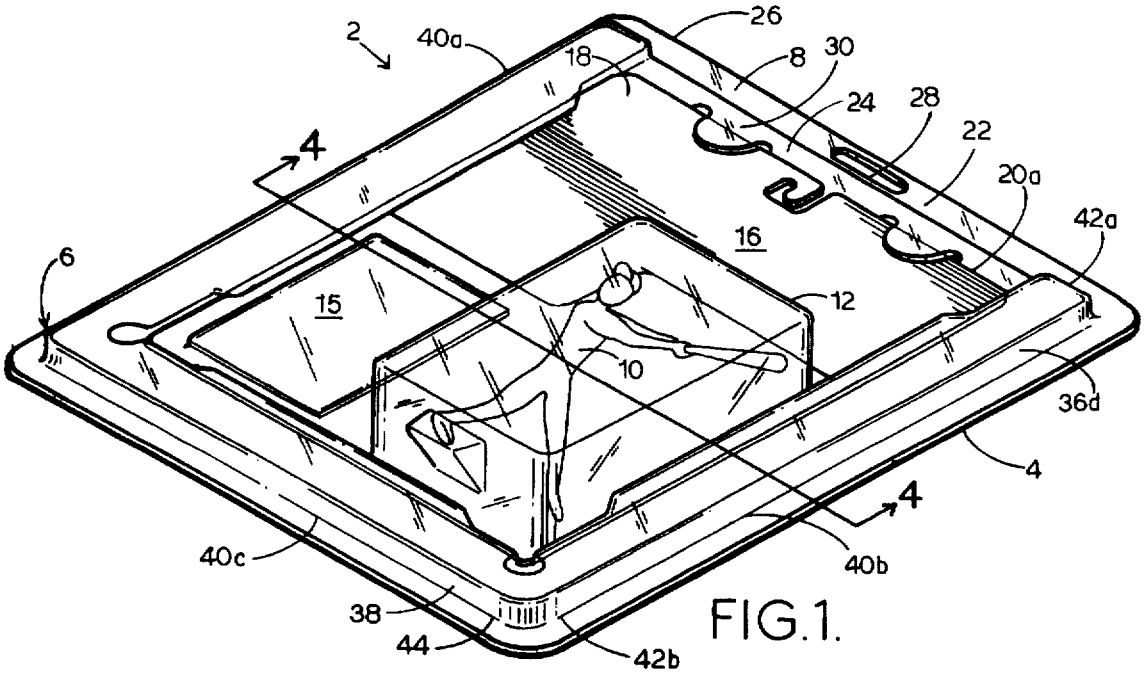
FIG. 1 is a perspective view of a protective display for a card-mounted collectible embodying the present invention.
Figure 4:
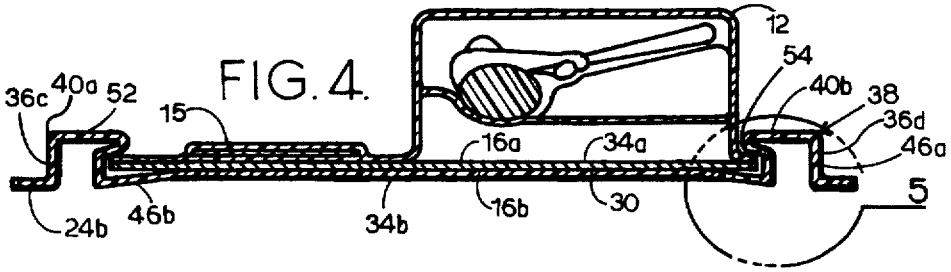
FIG. 4 is a cross-sectional view thereof taken generally along line 4—4 in FIG. 1.
Figure 5:
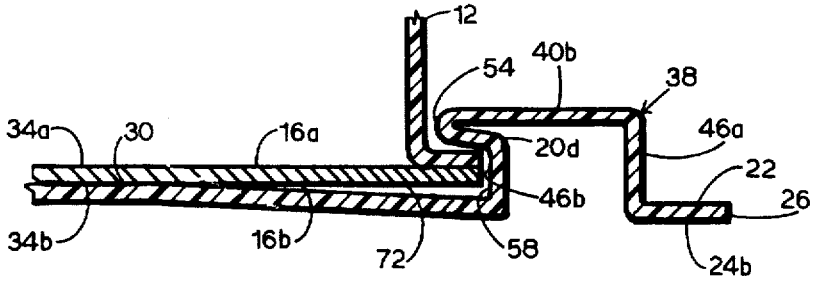
FIG. 5 is an enlarged, fragmentary, vertical cross-sectional view thereof taken generally within circle 5 in FIG. 4.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Certain terminology will be used in the following description for convenience in reference only and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Referring to the drawings in more detail, the reference numeral 2 generally indicates a display embodying the present invention. The display 2 generally comprises a base 4 and a frame assembly 6. Without limitation on the generality of useful applications of the display 2, it is shown and described in connection with a display item 8 comprising a figurine 10 enclosed by a clear plastic bubble-type cover 12 mounted on a relatively rigid backing card 14. Alongside the figurine 10, printed materials 15 can also be mounted on the backing card 14 by the transparent, plastic cover 12 for viewing therethrough, e.g., in a retail display context. Such printed materials 15 can comprise, for example, printed cards which include information, photographs and the like pertaining to the FIG. 10. Such cards are often printed for professional athletes and retail packaging in this fashion permits sales of both cards and figurines.

The backing card 14 includes front and back faces 16*a*, 16*b* and upper, lower and opposite side edges 20*a*, 20*b*, 20*c* and 20*d* forming respective corners 18 at their intersections. Without limitation on the generality of display items 8 which can be displayed with the display 2 comprising the present invention, such items can be provided with backing cards 14 comprising cardboard, paper, plastic, etc. "Backing card" shall be understood to encompass such a variety of different materials, sizes, configurations, etc.

II. Base 4

The base 4 includes a generally rectangular, planar field portion 22 with front and back surfaces 24*a*, 24*b* and a perimeter 26. A horizontally extending slot 28 is formed in the field portion 22, preferably located approximately in the center of an upper section of the field portion 22. The slot 28 is adapted for suspending the display 2 on hooks and the like. The horizontal orientation of the slot 28 and its width accommodate display items 8 with centers of gravity off-center from the vertical axis of the display 2.

III. Frame Assembly 6

The frame assembly 6 includes a generally planar panel 30 with upper, lower and opposite side edges 32*a–b* and front and back panel surfaces 34*a–b*. The frame assembly 6 includes upper, lower and opposite sidewalls 36*a*, 36*b*, 36*c* and 36*d* which engage the base front surface 24*a* and project forwardly therefrom.

A containment rail subassembly 38 includes a pair of opposite side rails 40*a*, 40*b* connected to a lower rail 40*c* to form a U-shaped configuration. The side rails 40*a*, 40*b* include upper and lower ends 42*a*, 42*b*, the latter being connected to respective lower rail opposite ends 44 at rail intersections or corners 48. Each rail 40*a*, 40*b*, 40*c* includes an outer wall 46*a* generally contiguous with a respective frame assembly wall 36*b*, 36*c*, 36*d* and an inner wall 46*b*. The rail outer walls 46*a* intersect at rounded outer corners 48*a* and the rail inner walls intersect at respective inner corners 48*b*, such corners being located at the intersections 48 of the side rail lower ends 42*b* and the lower rail opposite ends 44. Each rail inner corner 48*b* forms a rounded cut-out 50 for receiving a respective backing card corner 18 in a protected relationship and communicating with a respective rail inner wall 46*b* by a flared transition section 49.

Each rail 40*a*, 40*b*, 40*c* includes a respective front panel 52 forming a lip 54 with opposite ends 56 located in spaced relation from respective rail ends 42*a*, 42*b*, 44. Each lip 54 projects inwardly from a respective rail inner wall 46 over a perimeter portion of the frame assembly panel front surface 34*a* to form an inwardly-open notch 58 between a respective lip 54 and the panel 30. The notches 58 collectively form a receiver 60 for capturing the display item card edges 20*b*, 20*c*, 20*d*. The receiver 60 is upwardly-open at a mouth 62 since there is no rail at the panel upper edge 32*a*. Backing cards such as 14 may thus be slid into the receiver 60 over the panel upper edge 32*a*. The backing card 14 will generally be retained in place by the lips 54 and by gravity with the display 2 in an upright or horizontal position.

In order to more securely retain the display item 8 within the display 2, the panel 30 is provided with retaining means comprising a pair of tabs 64 formed by semi-circular cutouts 66 in the panels 30. The tabs 64 are located on opposite sides of the display vertical axis. With the display item backing card 14 in place in the receiver 60, one or both of the tabs 64 can be folded forwardly and over the card upper edge 20*a* for retaining same in place.

The panel 30 includes a pair of opposite side recesses 68*a*, 68*b* and a lower recess 68*c* each located in proximity to the inner wall 46*b* of a respective rail 40*a*, 40*b*, 40*c*. Each recess 68 includes opposite ends 70 and is slightly longer than a respective overlying lip 54 whereby the recess ends 70 project beyond the lip ends 56, but terminate short of the respective rail ends 42*a*, 42*b*, 44. The recesses have generally longitudinal configurations and are located in proximity to the respective rail inner walls 46*b*. The recesses primarily serve two purposes: (1) to enhance protection of the backing card side and lower edges 20*b*, 20*c*, 20*d* by providing an air gap 72 therealong, which air gap reduces contact between the plastic display 2 and the backing card along the side and lower edges 20*b*, 20*c*, 20*d* thereof and the panel 30; and (2) in the manufacture of the display 2, the recesses 68*a*, 68*b*, 68*c* provide extra clearance for a portion of the mold or die which forms the lips 54 and the notches 58.

IV. Manufacture and Operation

The display 2 can be manufactured by various suitable methods, particularly a pressure forming process utilizing a mold with pressure applied to one side thereof and a vacuum drawn on the other, which process tends to produce relatively high-quality finished products with sharply defined details and the like.

A clear view area 74 is bounded by the rail subassembly 98 and provides a substantially unobstructed view of the backing card front face 16*a* and the figurine 10 mounted thereon. The display 2 can be manufactured from a variety of suitable materials, including clear polyvinyl chloride (PVC) plastic and other suitable plastics and other materials, including cardboard, hardwood, wood, metal and the like. Various sizes and configurations of the display 2 can also be provided to accommodate a wide range of display items 8 of various sizes and configurations. The display 2 substantially protects the backing cards 14, whether paper, cardboard, plastic, etc., including the edges and corners thereof, against impact related damage from dropping, mishandling and the like. Moreover, by mounting a display item 8 in an appropriately-sized backing 2, risk of loss and theft can be reduced. Due to the relatively flat configuration of the display 2 a pair of such displays 2 with display items 8 mounted therein can be placed face-to-face and bottom-to-top whereby two such combined units can be stored efficiently in a relatively compact space.

It is to be understood that while certain forms of the present invention have been illustrated and described herein, it is not to be limited to the specific forms or arrangement of parts described and shown.

What is claimed and desired to be secured by Letters Patent is as follows:

1. A display for a card-type item with a card having front and back surfaces and upper, lower and opposite side edges, which comprises:

(a) a frame assembly including:

1) a panel having front and back surfaces and upper, lower and opposite side edges;

2) a pair of frame said rails positioned in parallel, spaced relation in proximity to said opposite pair side edges and projecting forwardly therefrom; and 3) a view area portion formed between said frame rails; and 4) each said frame rail including spaced inner and outer sidewalls;

b) each said frame rail including a lip projecting inwardly from a respective said inner sidewall and positioned in spaced relation forwardly from said view area portion;

c) a pair of notches each formed between respective said lip and said view area portion extending generally longitudinally along a respective said rail; and (d) a bottom frame assembly rail extending between said pair of frame side rails and extending generally parallel to and adjacent to said panel lower edge.

2. The display according to claim 1 wherein:

(a) each said side rail includes upper and lower ends; and (b) said bottom rail includes a pair of opposite ends each connected to a respective side rail lower end.

3. The display according to claim 2, which includes:

(a) said frame rails being located in spaced relation forwardly from said panal front surface.

4. The display according to claim 1, which includes:

(a) a base including a generally planar field portion extending outwardly from said frame assembly and terminating at a base perimeter.

5. The display according to claim 4, wherein:

(a) said frame assembly panel is spaced forwardly from said field portion of said base.

6. A display for a card-type item with a card having front and back surfaces and upper, lower and opposite side edges, which comprises:

(a) a frame assembly including:

1) a panel having front and back surfaces and upper, lower and opposite side edges;

2) a pair of frame rails positioned in parallel, spaced relation in proximity to said opposite pair side edges and projecting forwardly therefrom; and 3) a view area portion formed between said frame rails; and 4) each said frame rail including inner and outer sidewalls;

b) each said frame rail including a lip projecting inwardly from a respective said inner sidewall and positioned in spaced relation forwardly from said view area portion; and c) a pair of notches each formed between a respective said lip and said view area portion extending generally longitudinally along a respective said rail;

(d) a base including a generally planar field portion extending outwardly from said frame assembly and terminating a base perimeter; and (e) a horizontal slot formed in said base field portion above said frame assembly upper edge.

7. A display for a card-type item with a card having front and back surfaces and upper, lower and opposite side edges, which comprises:

(a) a frame assembly including:

1) a panel having front and back surfaces and upper, lower and opposite side edges;

2) a pair of frame rails positioned in parallel, spaced relation in proximity to said opposite pair side edges and projecting forwardly therefrom; and 3) a view area portion formed between said frame rails; and 4) each said frame rail including inner and outer sidewalls;

b) each said frame rail including a lip projecting inwardly from a respective said inner sidewall and positioned in spaced relation forwardly from said view area portion; and c) a pair of notches each formed between a respective said lip and said view area portion extending generally longitudinally along a respective said rail;

d) a plurality of recesses in said frame assembly panel each located adjacent to a respective said rail behind a respective said lip thereof.

8. The invention of claim 7, wherein:

(a) each said recess includes opposite ends with rounded configurations and each said rail includes opposite ends;

(b) each said lip has opposite ends located in spaced relation inwardly from ends of a respective said rail; and (c) each said recess end being located between a respective said lip end and a respective said rail end.

9. The display according to claim 8 wherein said recess ends are rounded.

10. A display for a card-type item with a card having front and back surfaces and upper, lower and opposite side edges, which comprises:

(a) a frame assembly including:

1) a panel having front and back surfaces and upper, lower and opposite side edges;

2) a pair of frame rails positioned in parallel, spaced relation in proximity to said opposite pair side edges and projecting forwardly therefrom; and 3) a view area portion formed between said frame rails; and 4) each said frame rail including inner and outer sidewalls;

b) each said frame rail including a lip projecting inwardly from a respective said inner sidewall and positioned in spaced relation forwardly from said view area portion; and c) a pair of notches each formed between a respective said lip and said view area portion extending generally longitudinally along a respective said rail;

d) said rails comprising first and second side rails; and e) a bottom frame assembly rail extending between said first and second side rails and extending generally parallel to and adjacent to said panel lower edge.

f) each said side rail includes upper and lower ends; and g) said bottom rail includes a pair of opposite ends each connected to a respective side rail lower end.

h) each said rail having an outer sidewall positioned opposite from a respective lip; and i) said frame assembly having a sidewall formed by said rail sidewalls.

11. The display according to claim 10, which includes:

(a) each said side rail lower end intersecting a respective bottom rail opposite end and forming inside and outside corners thereat;

(b) each said rail including said inner sidewall with said lip projecting therefrom; and (c) said inside and outside corners formed by said rail inner and outer sidewalls respectively at said intersections of said side rail lower ends and said bottom rail opposite ends.

12. The display according to claim 11, which includes:

(a) a fragmentary, circular cutout formed at each said inside corner for receiving a respective corner of said card.

13. The display according to claim 1, which comprises a pressure-formed polymeric material.

14. A display for a card-type item with a card having front and back surfaces and upper, lower and opposite side edges, which comprises:

(a) a frame assembly including:

1) a panel having front and back surfaces and upper, lower and opposite side edges;

2) a pair of frame rails positioned in parallel, spaced relation in proximity to said opposite pair side edges and projecting forwardly therefrom; and 3) a view area portion formed between said frame rails; and 4) each said frame rail including inner and outer sidewalls;

b) each said frame rail including a lip projecting inwardly from a respective said inner sidewall and positioned in spaced relation forwardly from said view area portion; and c) a pair of notches each formed between a respective said lip and said view area portion extending generally longitudinally along a respective said rail.

d) retention means located in proximity to said frame assembly upper edge and adapted for engaging said card upper edge for retaining said display item on said display.

15. The display according to claim 14, wherein:

(a) said retention means comprises a pair of semi-circular cutouts in said frame assembly panel in proximity to said frame assembly upper edge, each said cutout being downwardly-convex and forming a tab adapted for placement over the card type item upper edge.

16. A display for cards and items mounted on cards with upper and lower edges, opposite side edges and front and back card faces, which comprises:

(a) a base having a field portion with front and back surfaces and a base perimeter;

(b) a frame assembly spaced inwardly from said base perimeter and projecting forwardly from said base field portion front surface, said frame assembly including:

(1) a generally planar panel;

(2) upper, lower and opposite side frame assembly edges bounded by said base field portion;

(3) lower and opposite side frame assembly walls at respective said frame assembly edges;

(4) a pair of opposite side rails each including an side rail outer wall generally contiguous with a respective side frame assembly wall, a side rail inner wall, and upper and lower ends;

(5) a bottom rail including a bottom rail outer wall generally contiguous with said side frame assembly lower wall, opposite ends and a bottom rail inner wall extending generally parallel to said bottom rail outer wall;

(6) each said side rail intersecting at said lower end thereof with a respective bottom rail end and forming a rail intersection thereat, each said rail intersection having an inside corner at an intersection of said inner rail walls and an outside corner at an intersection of said outer rail walls;

(7) a view area bounded by said side and bottom rails and adapted to receive said card with said card front face substantially exposed thereat;

(8) each said side and bottom frame rails including a front panel with an outer edge terminating at a respective outer rail wall and a lip projecting inwardly from respectively said rail inner wall thereof and terminating at a front panel inner edge, said lip being located in spaced relation forwardly from said view area and forming a notch therebetween extending generally longitudinally along and bounded by a respective rail inner wall;

(9) a pair of partially circular cutouts each located at a respective rail intersection inner corner and adapted to receive a respective card corner; and

(10) a mouth located in proximity to said frame assembly upper edge and having a mouth opening with a width corresponding to a width of said card;

(c) a generally horizontal slot formed in said base field portion and located in proximity to said frame assembly upper edge between said frame assembly upper sidewall and said base perimeter; and (d) a pair of semi-circular cutouts formed in said frame assembly panel in proximity to said frame assembly upper edge and a pair of tabs each formed by a respective cutout for placement over the card front face at the card upper edge for retaining said card within said view area.

* * * * *